US006761111B2

(12) United States Patent
Chagnon et al.

(10) Patent No.: US 6,761,111 B2
(45) Date of Patent: Jul. 13, 2004

(54) CATCHING DEVICE FOR A TORN TRANSPORT BELT IN A FOLDER OF A PRINTING PRESS AND FOLDER HAVING A CATCHING DEVICE

(75) Inventors: Franck Chagnon, Saint Leu D Esserent (FR); Jean-Francois Robert, Creil (FR); Philippe Robin, Cires les Mello (FR)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 10/254,722

(22) Filed: Sep. 25, 2002

(65) Prior Publication Data

US 2003/0061954 A1 Apr. 3, 2003

(30) Foreign Application Priority Data

Sep. 28, 2001 (DE) ..... 101 48 004

(51) Int. Cl.[7] ..... B41F 13/24
(52) U.S. Cl. ..... 101/232; 101/219
(58) Field of Search ..... 101/232, 219, 101/217, 216, 212, 484; 399/165, 162; 271/10.06, 10.07, 10.08, 4.06, 4.05; 400/249; 226/11

(56) References Cited

U.S. PATENT DOCUMENTS

| | | | | | |
|---|---|---|---|---|---|
| 3,737,115 | A | * | 6/1973 | Baker | 242/420.3 |
| 4,564,099 | A | * | 1/1986 | Uozumi | 198/323 |
| 4,708,301 | A | | 11/1987 | Kataoka | 242/75.51 |
| 4,887,532 | A | | 12/1989 | Kotterer | 101/225 |
| 4,928,538 | A | * | 5/1990 | Burdess et al. | 73/862.41 |
| 5,163,371 | A | | 11/1992 | Kotterer et al. | 101/484 |
| 5,580,044 | A | * | 12/1996 | Wafler | 271/275 |
| 6,131,727 | A | * | 10/2000 | Nelson | 198/810.02 |

FOREIGN PATENT DOCUMENTS

| | | |
|---|---|---|
| DE | 34 31 686 A1 | 4/1986 |
| DE | 38 22 496 C2 | 1/1990 |
| DE | 42 19 645 C2 | 12/1993 |
| DE | 101 06 945 A1 | 8/2002 |
| EP | 0 318 853 | 6/1989 |
| EP | 0 476 437 A1 | 3/1992 |

* cited by examiner

*Primary Examiner*—Anthony H. Nguyen
(74) *Attorney, Agent, or Firm*—Laurence A. Greenberg; Werner H. Stemer; Gregory L. Mayback

(57) ABSTRACT

A device for catching a torn transport belt, includes a holding device for the transport belt. The holding device has two catching elements between which the transport belt runs, for holding the transport belt firmly therebetween. A first one of the two catching elements has a convex surface facing towards the transport belt, and the second one of the two catching elements has a concave surface facing towards the transport belt. Also included is a device for measuring tension of the transport belt, the tension measuring device being constructed for triggering the holding device when the tension of the transport belt falls below a prescribed value. A folder including the catching device is also provided.

11 Claims, 3 Drawing Sheets

CATCHING DEVICE FOR A TORN TRANSPORT BELT IN A FOLDER OF A PRINTING PRESS AND FOLDER HAVING A CATCHING DEVICE

BACKGROUND OF THE INVENTION

Field of the Invention

The invention relates to a catching device for a torn transport belt in a folder of a printing press and to a folder having a catching device.

A catching device of this general type is disclosed in German Published, Non-Prosecuted Patent Application DE 101 06 945 A1. As described therein, the catching device includes a holding device for a transport belt, which has two catching elements between which the transport belt runs and which can hold the latter firmly therebetween, a surface of a first one of the catching elements facing towards the transport belt being convex. The catching device also includes a measuring device for measuring tension of the transport belt, which is constructed so that when the tension falls below a prescribed value, the holding device is triggered.

The transport belt can be part of a transport device for flat products, whether they are signatures or a printing material web, such as for printed copies which are processed in a folder disposed downstream from a planographic printing press or a rotary printing press, in particular a web-fed rotary printing press. In this regard, the transport device can comprise a plurality of such transport belts formed as an endless belt, which are disposed side-by-side and together form the transport surface. However, it can also comprise a single, long endless belt which is guided in such a manner that it forms a plurality of individual strands, respectively, representing one transport belt, the individual strands being disposed beside one another and together forming the transport surface.

In the heretofore-known catching device, the first catching element is a catching roller having a circumferential surface forming the convex surface facing the transport belt. The catching roller is pressed against the transport belt by a pretensioning element and, due to the tension prevailing in the transport belt, is kept at a distance from the second catching element which, in the case of the heretoforeknown catching device, is formed by a locally fixed stop element. This stop element is formed as a round rod which extends transversely to the revolving direction of the transport belt, so that the surface of the second catching element facing the transport belt is also convex.

If the transport belt should then tear upstream of the catching device, as viewed in the revolving direction, the tension of the transport belt collapses thereat and is therefore no longer sufficient to keep the pretensioned catching roller at a distance from the stop element. The catching roller is therefore moved towards the stop element by the pretensioning element and pressed against the stop element, so that the transport belt is clamped therebetween and firmly held. The pretensioning element can therefore be viewed as a measuring device for the tension of the transport belt, because it triggers the holding device when the tension falls below the prescibed value.

One disadvantage of this heretofore-known catching device is that the catching roller and the stop element rest only on a very narrow strip of the transport belt with the convex surfaces thereof facing towards the transport belt, and therefore cannot hold the transport belt sufficiently firmly.

Published European Patent Application EP 0 318 853 A, corresponding to U.S. Pat. No. 4,887,532, discloses a catching device for a torn paper web in a web-fed rotary printing press. Disposed downstream from a printing unit is a clamping and/or severing device for the web, which is formed with a passage slot and is actuatable by a web scanning device that detects a web break. The clamping and/or severing device has clamping jaws and/or knock-off knives which are movable towards one another. However, the precise form of two cooperating clamping jaws cannot be determined from this document.

Published European Patent Application EP 0 476 437 A, corresponding to U.S. Pat. No. 5,163,371, discloses a catching device for a torn printing material web in a web-fed rotary printing press. This heretofore-known catching device has a clamping device disposed downstream from a printing unit and a web break switch. The clamping device comprises a driven roller and a rotor movable by a setting or adjusting device, the printing material web running between the roller and the rotor. The setting device is activatable by the web break switch and then moves the rotor into contact with the roller.

In this heretofore-known catching device, too, the surfaces of the roller and the rotor which face the printing material web are convex.

SUMMARY OF THE INVENTION

It is therefore an object of the invention to provide a catching device for a torn transport belt in a folder of a printing press and a folder having a catching device, which can hold the transport belt more firmly than the heretofore-known catching devices and folders of this general type.

With the foregoing and other objects in view, there is provided, in accordance with one aspect of the invention, a device for catching a torn transport belt. The catching device comprises a holding device for the transport belt, which has two catching elements between which the transport belt runs, the catching elements serving for holding the transport belt firmly therebetween. A first one of the two catching elements has a convex surface facing towards the transport belt, and the second one of the two catching elements has a concave surface facing towards the transport belt. Also provided is a device for measuring tension of the transport belt, the tension measuring device being constructed for triggering the holding device when the tension of the transport belt falls below a prescribed value.

In accordance with another feature of the invention, the first catching element is a roller and the second catching element is a channel, the roller having a rotational axis extending at least approximately parallel to a longitudinal axis of the channel.

In accordance with a further feature of the invention, the channel has a V-shaped cross section.

In accordance with an added feature of the invention, the channel has a circular cross section with an inner diameter at least equal to the diameter of the roller.

In accordance with an additional feature of the invention, in order to hold the transport belt firmly, at least one of the first and the second catching elements is movable towards the respective other of the first and the second catching elements.

In accordance with yet another feature of the invention, the roller is pretensioned against the transport belt.

In accordance with yet a further feature of the invention, the measuring device comprises a pull cylinder having a piston rod to which the roller is affixed, and a housing to which the channel is affixed.

In accordance with yet an added feature of the invention, the measuring device has an end position transmitter disposed at an end of the cylinder housing distal from the channel.

In accordance with yet an additional feature of the invention, the measuring device is constructed for registering a change in speed of a section of the transport belt.

In accordance with still another feature of the invention, the measuring device is constructed for registering speeds of two different sections of the transport belt.

In accordance with still a further feature of the invention, the catching device further comprises at least one further holding device disposed at another location of the transport belt and connected to the measuring device.

In accordance with still an added feature of the invention, the further holding device comprises a clamping block formed with a guide groove wherein the transport belt runs, and a clamping jaw pressed against the base of the guide groove for firmly holding the transport belt.

In accordance with a concomitant aspect of the invention, there is provided a folder disposed downstream of a printing press, as viewed in travel direction of a printing product. The folder includes a device for catching a torn transport belt, which comprises a holding device for the transport belt. The holding device has two catching elements between which the transport belt runs, for holding the transport belt firmly therebetween. A first one of the two catching elements has a convex surface facing towards the transport belt, and the second one of the two catching elements has a concave surface facing towards the transport belt. The catching device further comprises a device for measuring tension of the transport belt, the tension measuring device being constructed for triggering the holding device when the tension of the transport belt falls below a prescribed value.

Thus, the catching device according to the invention is characterized in that that surface of the second catching element which faces the transport belt is concave.

Because the surface of the second catching element is concave, the areas wherein the catching elements rest on the transport belt when they hold it firmly are considerably larger than in the case of the heretoforeknown catching device. The transport belt can therefore be held more firmly.

If the measuring device for the tension is constructed so that the prescribed or predefined tension is virtually zero, then the tension will fall below this value during normal operation only if the transport belt tears. However, the transport belt can also cause undesired disruption if, although it does not tear, it experiences elongation or lengthening due to aging and stress over the course of time. This lengthening or elongation is likewise associated with a reduction in the tension, and the measuring device can also be constructed so that the prescribed tension is greater than the aforementioned very low tension, because typical tension is selected for the tearing. In this case, the measuring device will therefore also trigger the holding device when the maximum permissible lengthening of the transport belt is exceeded.

In addition, when the tension falls below the prescribed value, the measuring device can not only trigger the holding device but also stoppage of the transport belt drive and/or stoppage of the machines associated with the transport belt.

Provision can be made for the first catching element to be a roller and the second catching element a channel, and for the axis of rotation of the roller to extend at least approximately parallel to the longitudinal axis of the channel. In this case, provision can be made in a first alternative for the channel to have a V-shaped cross section, and in a second alternative for the channel to have a circular or U-shaped cross section, the inner diameter of which is equal to or greater than the diameter of the roller. In the case of the first alternative, in order to hold the transport belt firmly, the roller is moved into the channel until the roller is supported on two strip-like areas on the channel, wherein the transport belt is clamped firmly between roller and channel. In the case of the second alternative, the roller can be moved into the channel until it either rests completely on the channel, if the inner diameter of the latter is equal to the diameter of the roller, or rests on a broad strip-like area of the channel, if the inner diameter of the latter is greater than the diameter of the roller.

In addition, provision can be made, in order to hold the transport belt firmly, for the first and/or the second catching element to be moved towards the respective other catching element.

Furthermore, provision can be made for the roller to be pretensioned against the transport belt. As a result, the roller is moved farther towards the channel the greater the extent of decrease in the tension of the transport belt.

Furthermore, provision can be made for the measuring device to have a pull cylinder, to the piston rod of which the roller is fitted, and to the housing of which the channel is fitted. The pull cylinder therefore exerts pretension on the roller in the direction of the channel.

In this case, provision can be made for the measuring device to have an end position transmitter, which is fitted to that end of the cylinder housing which is opposite from the channel end. The end position transmitter will therefore be actuated by the piston of the pull cylinder when that piston has retracted entirely into the housing.

Furthermore, provision can be made for the measuring device to be constructed for registering the change in speed of a section of the transport belt. This is because if the transport belt should tear in the monitored section, the leading end of the transport belt, as viewed in the revolving direction, would experience a positive change in speed, i.e., an acceleration. Therefore, conversely, conclusions about the tearing of the transport belt can be drawn from a sudden acceleration of the monitored section.

Furthermore, provision can be made for the measuring device to be constructed for registering the speeds of at least two different sections of the transport belt. This is because if the transport belt should tear in the monitored section, the speed of this section would differ considerably from that of another section. Therefore, conversely, conclusions about the tearing of the transport belt can be drawn from the difference in speed of two different sections. If the transport device comprises a plurality of such transport belts, which are disposed beside one another and together form the transport surface, the measuring device can register and compare the speeds of the various transport belts, because it is improbable for two monitored transport belts to tear at the same time.

In addition, provision can be made for at least one further holding device also to be disposed at another location of the transport belt and be connected to the measuring device. As a result, the transport belt can be held firmly at a plurality of locations at the same time.

In this case, provision can be made for the further holding device to comprise a clamping block, which has a guide groove wherein the transport belt runs, and a clamping jaw which, to hold the transport belt firmly, is pressed against the base of the guide groove. The guide groove serves for guiding the transport belt during normal operation. In addition, in the event of a tear, it prevents the transport belt from being able to slip out laterally between clamping block and clamping jaw as it is being firmly held.

The catching device according to the invention can be used with particular advantage in a folder which is disposed downstream of a printing press, in particular a web-fed rotary printing press. Typically, a large number of transport belts are used in a folder. It is often the case that not all the locations on the paths formed by the transport belts are easily accessible, so that fixing the transport belt in the event of the tearing of the relevant transport belt maintains at least part of the path. The repair of the old or the installation of a new transport belt is made considerably easier and accelerated. Failure times and downtimes of the folder can be shortened.

Other features which are considered as characteristic for the invention are set forth in the appended claims.

Although the invention is illustrated and described herein as embodied in a catching device for a torn transport belt in a folder of a printing press and a folder having a catching device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
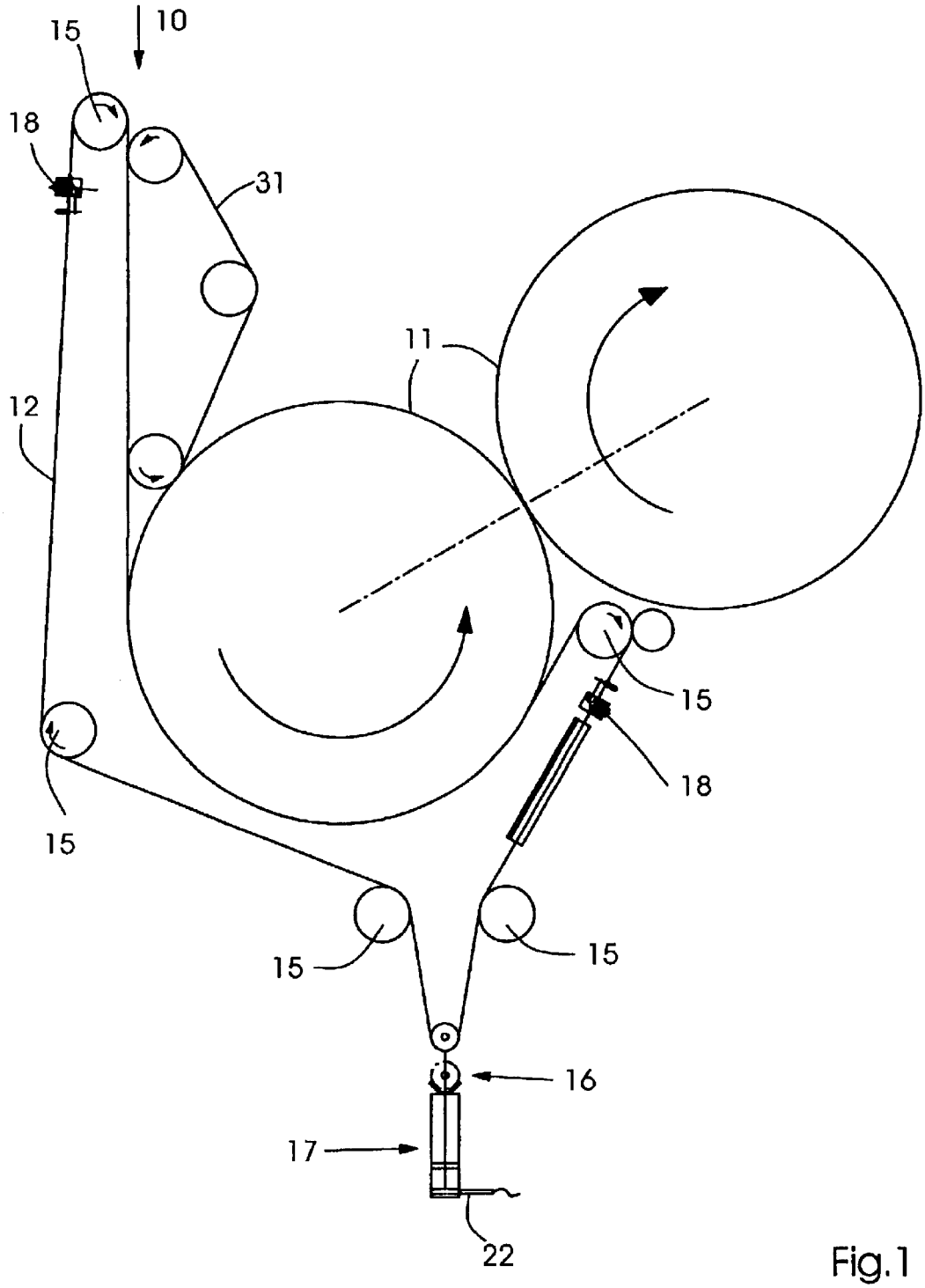
FIG. 1 is a diagrammatic, side-elevational view of a transport device for signatures or for a printing material, which includes a catching device for a torn transport belt according to the invention, in a preferred embodiment.

Referring now to the drawing and, first, particularly to FIG. 1 thereof, there is shown therein a transport device for signatures or a printing material web entering the transport device in the transport direction 10, and also two cylinders 11 of a folder wherein the signatures or the printing material web are processed. Here, the transport device has three identical transport belts 12, 13 and 14 (note FIG. 4) and an associated transport belt 31, which are respectively constructed as an endless belt, five drive and deflection rollers 15 for the transport belts 12 to 14 and a catching device for the transport belts 12 to 14.

The catching device has for each of the three transport belts 12 to 14, respectively, a first holding device, of which only the holding device 16 associated with the first transport belt 12 can be seen in FIG. 1, and, respectively, a measuring device for the tension of the associated transport belt 12 to 14, of which only the measuring device 17 associated with the first transport belt 12 can be seen in FIG. 1, and also two second holding devices 18 for the three transport belts 12 to 14 together.

Figure 2B:
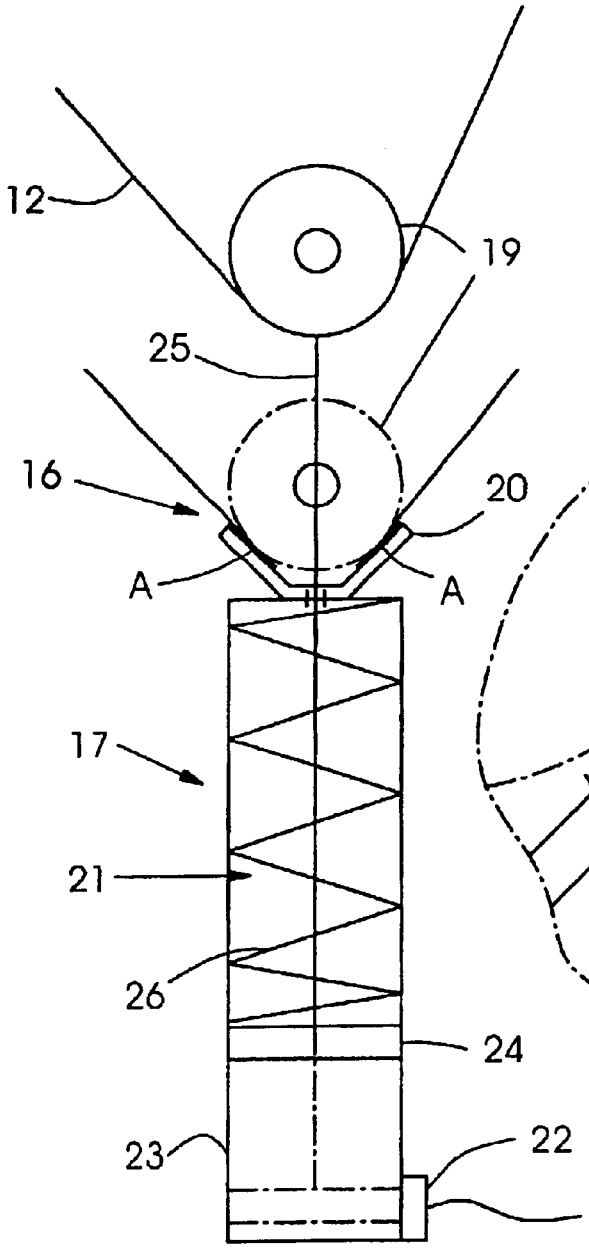
FIG. 2B is an enlarged, fragmentary view of FIG. 1, showing the catching device.

In FIG. 2B, the first holding device 16 and the measuring device 17 for the first transport belt 12 are shown enlarged. The first holding device 16 has two catching elements, between which the transport belt 12 runs and which can hold the latter firmly therebetween, as is described hereinafter in greater detail. The first catching element here is formed by a roller 19, which rests on the inside of the transport belt 12 and has an axis of rotation running perpendicularly to the revolving direction of the transport belt 12. Thus, that surface of the roller 19 which faces towards the transport belt 12 is the circumferential surface of the roller 19 and is consequently convex. The second catching element is formed here by a channel 20 having a V-shaped cross section.

The measuring device 17 has a draw or pull cylinder 21 and an end position transmitter 22. The pull cylinder 21 has a locally fixed cylinder housing 23, a piston 24 sliding therein with a piston rod 25, and a compression spring 26. The compression spring 26 is braced, on the one hand, against the upper edge of the cylinder housing 23 and, on the other hand, against the upper side of the piston 24, so that the piston 24 is prestressed downwardly in FIG. 2B, i.e., towards the bottom of the cylinder housing 23. At the free end of the piston rod 25, the latter is rotatably connected to the roller 19, so that the roller 19 is prestressed downwardly in FIG. 2B, i.e., against the transport belt 12, by the piston rod 25, the piston 24 and the compression spring 26. The end position transmitter 22 is accommodated at the bottom of the cylinder housing 23 and is therefore actuated when the piston 24 has been retracted entirely into the cylinder housing 23.

The channel 20 is fastened by the bottom thereof to the upper side of the cylinder housing 23 and is formed with a passage opening in the bottom thereof through which the piston rod 25 extends.

During normal operation, the transport belt 12 is under a given tension and, therefore, in force equilibrium, holds the roller 19, against the pretension exerted by the draw or pull cylinder 21, in the upper position illustrated in solid or continuous lines in FIG. 2B. Because, in this upper position thereof in FIG. 2B, the roller 19 and the transport belt 12 are spaced a distance from the channel 20, the transport belt 12 can run freely over the roller 19. If, then, the tension of the transport belt 12 should fall, for example, due to elongation thereof caused by aging and stress, the compression spring 26 will expand downwardly until it reaches force equilibrium again and, in the process, pull the roller 19 downwardly towards the channel 20 via the piston 24 and the piston rod 25. Therefore, the position of the piston 24 and of the roller 19 relative to the cylinder housing 23 and the channel 20 is a measure of the tension prevailing in the transport belt 12. The roller 19 and the pull cylinder 21 therefore together form the measuring device 17 for the tension of the transport belt 12.

If, then, the transport belt 12 should tear, the tension thereof will decrease drastically, so that the pull cylinder 21 will pull the roller 19 downwardly into the lower position thereof illustrated in phantom in FIG. 2B, and press it against the channel 20. In this lower position, the transport belt 12 will then be clamped between the convex outer surface of the roller 19 and the concave inner surface of the channel 20 in the two clamping areas A. The roller 19, the channel 20 and the pull cylinder 21 therefore together form the first holding device 16 of the transport belt 12.

Figure 2A:
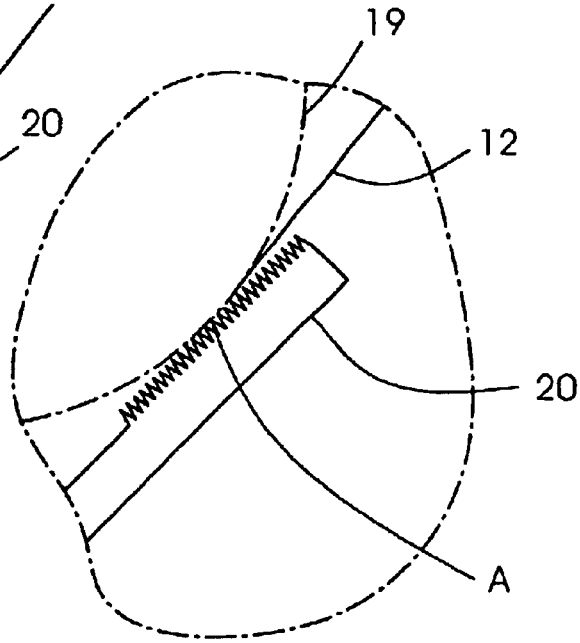
FIG. 2A is an enlarged, fragmentary view of FIG. 2B, showing a detail of the catching device.

In order to improve the clamping action, as shown in FIG. 2A, the inner surface of the channel 20, which faces the transport belt 12, can be grooved.

In this lower position, the piston 24 has been retracted as far as the bottom of the cylinder housing 23 and actuates the end position transmitter 22. This end position transmitter 22 then outputs a signal representative of the tearing of the transport belt 12 to a non-illustrated controller, which in turn initially stops the transport device and the printing unit immediately and secondly triggers the two second holding devices 18.

Figure 4:
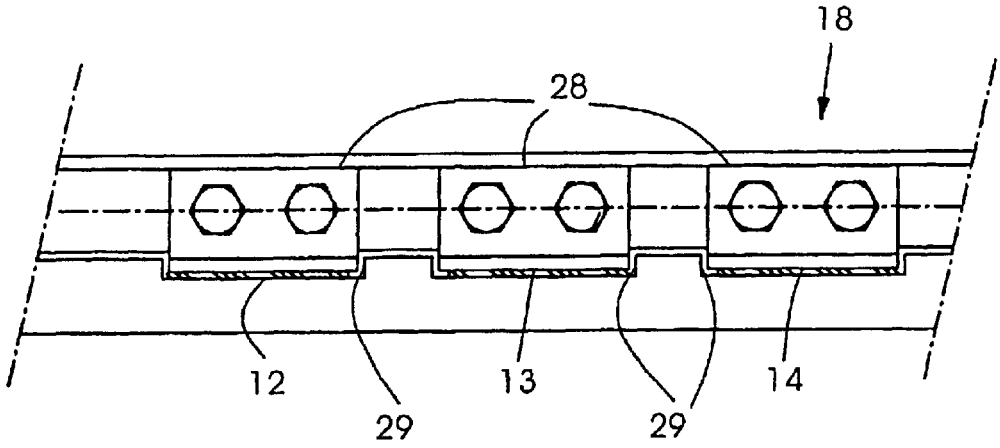
FIG. 4 is a reduced, front-elevational view of FIG. 3, showing the second holding device in further detail.
Figure 3:
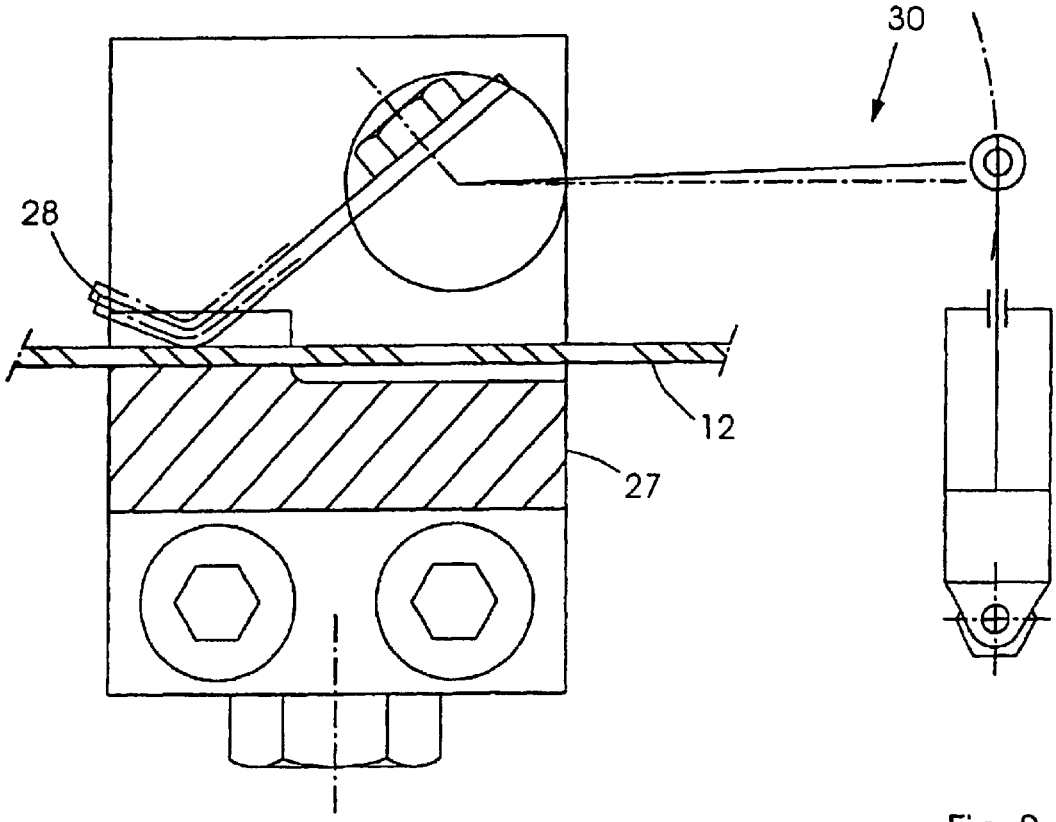
FIG. 3 is an enlarged, fragmentary, side-elevational view, partly in section, of FIG. 1., showing a second holding device for the transport belt in a preferred embodiment.

One of the two second holding devices 18 is shown enlarged in FIGS. 3 and 4. The second holding device 18 comprises a clamping block 27 and three clamping jaws 28 for the three transport belts 12 to 14. The clamping block 27 is formed with three guide grooves 29 which are disposed parallel and beside one another, one of the transport belts 12 to 14, respectively, running in one of the grooves 29. One of the clamping jaws 28 dips from above into each guide groove 29, so that the associated transport belt 12 to 14 runs between the underside of the clamping jaw 28 and the bottom of the guide groove 29. The three clamping jaws 28 are driven jointly by a drive 30, illustrated only diagrammatically here, in such a way that during normal operation they are kept at a distance from the upper side of the transport belts 12 to 14 and, in order to hold the transport belts 12 to 14 firmly, are pressed downwardly onto the bottom of the guide grooves 29, so that the transport belts 12 to 14 are clamped between the clamping jaws 28 and the clamping block 27.

We claim:

1. A device for catching a torn transport belt, comprising:

a holding device for the transport belt, said holding device having first and second catching elements for holding the transport belt firmly therebetween and between which the transport belt runs, said first catching element having a convex surface facing towards the transport belt, and said second catching element having a concave surface facing towards the transport belt; and a device for measuring tension of the transport belt, said tension measuring device triggering said holding device when the tension of the transport belt falls below a prescribed value.

2. The catching device according to claim 1, wherein said first catching element is a roller and said second catching element is a channel with a longitudinal axis, said roller having a rotational axis extending at least approximately parallel to said longitudinal axis of said channel.

3. The catching device according to claim 2, wherein said channel has a V-shaped cross section.

4. The catching device according to claim 2, wherein said channel has a circular cross section with an inner diameter at least equal to the diameter of said roller.

5. The catching device according to claim 1, wherein at least one of said first and second catching elements is movable towards the other of said first and second catching elements, for holding the transport belt firmly.

6. The catching device according to claim 2, wherein said roller is pretensioned against the transport belt.

7. The catching device according to claim 6, wherein said measuring device includes a pull cylinder having a piston rod to which said roller is affixed and a housing to which said channel is affixed.

8. The catching device according to claim 7, wherein said housing has an end distal from said channel, and said measuring device has an end position transmitter disposed at said end of said housing distal from said channel.

9. The catching device according to claim 1, further comprising at least one further holding device disposed at another location of the transport belt and connected to said measuring device.

10. The catching device according to claim 9, wherein said further holding device includes a clamping block formed with a guide groove having a bottom, the transport belt running in said guide groove, and a clamping jaw pressed against said bottom of said guide groove for firmly holding the transport belt.

11. A folder disposed downstream of a printing press, in travel direction of a printing product, the folder comprising:

a device for catching a torn transport belt, said catching device including:

a holding device for the transport belt, said holding device having first and second catching elements for holding the transport belt firmly therebetween and between which the transport belt runs, said first catching element having a convex surface facing towards the transport belt, and said second catching element having a concave surface facing towards the transport belt; and a device for measuring tension of the transport belt, said tension measuring device triggering said holding device when the tension of the transport belt falls below a prescribed value.

* * * * *